US007660714B2

(12) United States Patent
Furuta et al.

(10) Patent No.: US 7,660,714 B2
(45) Date of Patent: Feb. 9, 2010

(54) NOISE SUPPRESSION DEVICE

(75) Inventors: Satoru Furuta, Tokyo (JP); Shinya Takahashi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 252 days.

(21) Appl. No.: 11/927,415

(22) Filed: Oct. 29, 2007

(65) Prior Publication Data

US 2008/0059164 A1 Mar. 6, 2008

Related U.S. Application Data

(63) Continuation of application No. 10/276,292, filed as application No. PCT/JP01/02596 on Mar. 28, 2001, now Pat. No. 7,349,841.

(51) Int. Cl.
*G10L 21/02* (2006.01)

(52) U.S. Cl. ..... 704/228; 704/226; 704/233; 704/263; 379/392.01

(58) Field of Classification Search ..... 704/219, 704/226–228, 233, 210, 208; 375/346; 379/392.01, 379/406.01, 406.14, 406.03
See application file for complete search history.

(56) References Cited

U.S. PATENT DOCUMENTS

| | | | | |
|---|---|---|---|---|
| 4,630,305 A | | 12/1986 | Borth et al. | |
| 4,811,404 A | | 3/1989 | Vilmur et al. | |
| 5,327,520 A | * | 7/1994 | Chen | 704/219 |
| 5,432,859 A | | 7/1995 | Yang et al. | |
| 5,774,837 A | * | 6/1998 | Yeldener et al. | 704/208 |
| 5,812,970 A | * | 9/1998 | Chan et al. | 704/226 |
| 6,035,048 A | | 3/2000 | Diethorn | |
| 6,038,532 A | | 3/2000 | Kane et al. | |
| 6,041,297 A | * | 3/2000 | Goldberg | 704/219 |
| 6,173,258 B1 | * | 1/2001 | Menendez-Pidal et al. | 704/233 |
| 6,289,309 B1 | * | 9/2001 | deVries | 704/233 |
| 6,415,253 B1 | * | 7/2002 | Johnson | 704/210 |
| 6,453,285 B1 | * | 9/2002 | Anderson et al. | 704/210 |
| 7,343,283 B2 | * | 3/2008 | Ashley et al. | 704/219 |
| 7,492,889 B2 | * | 2/2009 | Ebenezer | 379/392.01 |

(Continued)

FOREIGN PATENT DOCUMENTS

EP 0 751 491 A2 1/1997

(Continued)

OTHER PUBLICATIONS

U.S. Appl. No. 11/927,354, filed Oct. 29, 2007, Furuta, et al.

(Continued)

*Primary Examiner*—Vijay B Chawan
(74) *Attorney, Agent, or Firm*—Oblon, Spivak, McClelland, Maier & Neustadt, L.L.P.

(57) ABSTRACT

A noise suppression device comprises subband SN ratio calculation means which receives a noise likeness signal, an input signal spectrum and a subband-based estimated noise spectrum, calculates the subband-based input signal average spectrum, calculates a subband-based mixture ratio of the subband-based estimated noise spectrum to the subband-based input signal average spectrum on the basis of the noise likeness signal, and calculates the subband-based SN ratio on the basis of the subband-based estimated noise spectrum, the subband-based input signal average spectrum and the mixture ratio.

2 Claims, 8 Drawing Sheets

U.S. PATENT DOCUMENTS 7,555,075 B2 * 6/2009 Pessoa et al. ..... 375/346

FOREIGN PATENT DOCUMENTS

| | | | |
|---|---|---|---|
| EP | 1 059 628 | A2 | 12/2000 |
| JP | 57-161800 | | 10/1982 |
| JP | 63-500543 | | 2/1988 |
| JP | 3-266899 | | 11/1991 |
| JP | 7-306695 | | 11/1995 |
| JP | 9-160594 | | 6/1997 |
| JP | 10-254499 | | 9/1998 |
| JP | 10-341162 | | 12/1998 |
| JP | 2000-82999 | | 3/2000 |

OTHER PUBLICATIONS

U.S. Appl. No. 11/927,478, filed Oct. 29, 2007, Furuta, et al.
U.S. Appl. No. 11/927,509, filed Oct. 29, 2007, Furuta, et al.
Steven F. Boll: "Suppression of acoustic noise in speech using spectral subtraction" IEEE Transactions on Acoustics, Speech, and Signal Processing, vol. ASSP-27, No. 2, pp. 113-120, Apr. 1979.

* cited by examiner

| SUBBAND NO. i | DISCRETE FREQUENCY f (SPECTRAL COMPONENT) | | FREQUENCY RANGE (Hz) |
|---|---|---|---|
| | fL[i] | fH[i] | |
| 1 | 0 | 0 | 0 - 30 |
| 2 | 1 | 3 | 30 - 90 |
| 3 | 4 | 6 | 90 - 180 |
| 4 | 7 | 9 | 180 - 280 |
| 5 | 10 | 12 | 280 - 375 |
| 6 | 13 | 16 | 375 - 500 |
| 7 | 17 | 20 | 500 - 625 |
| 8 | 21 | 24 | 625 - 750 |
| 9 | 25 | 29 | 750 - 900 |
| 10 | 30 | 34 | 900 - 1050 |
| 11 | 35 | 40 | 1050 - 1250 |
| 12 | 41 | 47 | 1250 - 1470 |
| 13 | 48 | 55 | 1470 - 1720 |
| 14 | 56 | 64 | 1720 - 2000 |
| 15 | 65 | 74 | 2000 - 2310 |
| 16 | 75 | 86 | 2310 - 2680 |
| 17 | 87 | 100 | 2680 - 3120 |
| 18 | 101 | 118 | 3120 - 3690 |
| 19 | 119 | 127 | 3690 - 4000 |

NOISE SUPPRESSION DEVICE

CROSS-REFERENCE TO RELATED APPLICATION

The present continuation application claims the benefit of priority under 35 U.S.C. §120 to application Ser. No. 10/276,292, filed Nov. 21, 2002 which is the National Stage of PCT/JP01/02596 filed on Mar. 28, 2001, the entire contents of both are incorporated herein by reference.

TECHNICAL FIELD

The present invention relates to noise suppression devices for suppressing noises other than, for example, speech signals in such systems as voice communications systems and speech recognition systems used in various noise environments.

BACKGROUND ART

Noise suppression devices for suppressing nonobjective signals such as noises mixed into speech signals are known, one of which has been disclosed in, for example, Japanese Patent Application Laid-Open No. 7-306695. The noise suppression device as disclosed by this Japanese application is based on what is called the spectral subtraction method, wherein noises are suppressed over an amplitude spectrum, as suggested by Steven F. Boll, "Suppression of Acoustic Noise in Speech using Spectral Subtraction," IEEE Trans. ASSP, Vol. ASSP-27, No. 2, April 1979.

FIG. 1 is a block diagram showing a configuration of a conventional noise suppression device disclosed in the above-identified Japanese application. In the figure, reference numeral 111 denotes an input terminal; 112, a framing/windowing circuit; 113, an FFT circuit; 114, a frequency division circuit; 115, a noise estimation circuit; 116, speech estimation circuit; 117, a Pr(Sp) calculating circuit; 118, a Pr(Sp|Y) calculating circuit; 119, a maximum likelihood filter; 120, a soft decision suppression circuit; 121, a filter processing circuit; 122, band conversion circuit; 123, a spectrum correction circuit; 124, an IFFT circuit; 125, an overlap-and-add circuit; and 126 denotes an output terminal.

FIG. 2 is a block diagram showing a configuration of the noise estimation circuit 115 in the conventional noise suppression device. In the figure, reference numeral 115A denotes an RMS calculating circuit; 115B, a relative energy calculating circuit; 115C, a minimum RMS calculating circuit; and 115D denotes a maximum signal calculating circuit.

The operation will be explained below.

An input signal y[t] containing a speech component and a noise component is supplied to the input terminal 111. The input signal y[t], which is a digital signal having the sampling frequency of FS, is fed to the framing/windowing circuit 112 where it is divided into frames each having a length equal to FL samples, for example 160 samples, and windowing is performed prior to the subsequent FFT processing.

The FFT circuit 113 performs 256-point FFT processing to produce frequency spectral amplitude values which are divided by the frequency dividing circuit 114 into e.g., 18 bands.

The noise estimation circuit 115 distinguishes the noise in the input signal y[t] from the speech and detects a frame which is estimated to be the noise. The operation of the noise estimation circuit 115 is explained below by referring to FIG. 2.

In FIG. 2, the input signal y[t] is fed to a root-mean-square value (RMS) calculating circuit 115A where short-term RMS values are calculated on the frame basis. The short-term RMS values are supplied to the relative energy calculating circuit 115B, the minimum RMS calculating circuit 115C, the maximum signal calculating circuit 115D and the noise spectrum estimating circuit 115E. The noise spectrum estimating circuit 115E is fed with outputs of the relative energy calculating circuit 115B, the minimum RMS calculating circuit 115C and the maximum signal calculating circuit 115D, while being fed with an output of the frequency division circuit 114.

The RMS calculating circuit 115A calculates a RMS value RMS[k] for each frame according to the equation (1). The relative energy calculating circuit 115B calculates the current frame's relative energy dB_rel[k] to the decay energy (decay time 0.65 second) from the previous frame.

$$\mathrm{RMS}[k] = sqrt\left(\sum_{t=1}^{FL} y^2[t]\right) \tag{1}$$

$$\mathrm{dB_rel}[k] = 10\log10(\mathrm{E_dec}[k]/E[k])$$

$$E[k] = \sum y^2[t]$$

$$\mathrm{E_dec}[k] = \max(E[k], \exp(-FL/0.65 * FS)\mathrm{E_dec}[k-1])$$

The minimum RMS calculating circuit 115C calculates the current frame's minimum noise RMS value MinNoise_short and a long-term minimum noise RMS value MinNoise_long which is updated every 0.6 second so as to evaluate the background noise level. The long-term minimum noise RMS value MinNoise_long is used alternatively when the minimum noise RMS value MinNoise_short cannot track or follow sharp changes in the noise level.

The maximum signal calculating circuit 115D calculates the current frame's maximum signal RMS value MaxSignal_short, and a long-term maximum signal RMS value MaxSignal_long which is updated every e.g., 0.4 second. The long-term maximum signal RMS value MaxSignal_long is used alternatively when the current frame's maximum signal RMS value cannot follow sharp changes in the signal level. The current frame signal's maximum SNR value MaxSNR may be estimated by employing the short-term maximum signal RMS value MaxSignal_short and the short-term minimum noise RMS value MinNoise_short. In addition, using the maximum SNR value MaxSNR, a normalized parameter NR_level in a range from 0 to 1 indicating the relative noise level is calculated.

Then, the noise spectrum estimation circuit 115E determines whether the mode of the current frame is speech or noise by using the values calculated by the relative energy calculating circuit 115B, minimum RMS calculating circuit 115C and maximum signal calculating circuit 115D. If the current frame is determined as noise, the time averaged estimated value of the noise spectrum N[w, k] is updated by the signal spectrum Y[w, k] of the current frame where w denotes the number of the bands produced through the band division.

The speech estimation circuit 116 in FIG. 1 calculates the SN ratio in each of the frequency bands w produced through the band division. First, a rough estimated value S'[w, k] of the speech spectrum is calculated in accordance with the following equation (2) by assuming a noise-free condition (clean condition). The rough estimated value S'[w, k] of the speech spectrum may be employed for calculating the probability Pr(Sp|Y) to be explained later. ρ in the equation (2) is a predetermined constant and set to e.g., 1.0.

$$S'[w,k]=sqrt(\max(0,Y[w,k]^2-\rho N[w,k]^2)) \tag{2}$$

Then, using the above described speech spectral rough estimated value S'[w, k] and the speech spectral estimated value S[w, k−1] of the immediately preceding frame, the speech estimation circuit 116 calculates the current frame's speech spectrum estimated value S[w, k]. Using the calculated speech spectrum estimated value S[w, k] and the noise spectrum estimated value N[w, k] fed from the noise spectrum estimation circuit 115E, the subband-based SN ratio SNR[w, k] is calculated in accordance with the following equation:

$$SNR[w,k] = 20\log10\left(\frac{0.2*S[w-1,k]+0.6*S[w,k]+0.2*S[w+1,k]}{0.2*N[w-1,k]+0.6*N[w,k]+0.2*N[w+1,k]}\right). \quad (3)$$

Then, to cope with a wide range of the noise/speech level, a variable value SN ratio SNR_new[w, k] is calculated in accordance with the following equation (4) by use of the SN ratio SNR[w, k] of each of subbands. MIN_SNR( ) in equation (3) is a function to determine the minimum value of SNR_new[w, k] and the argument snr is a synonym for the subband SN ratio SNR[w, k].

$$SNR_new[w,k]=\max(MIN_SNR(SNR[w,k]),S'[w,k]/N[w,k])$$

$$MIN_SNR(snr) = \begin{cases} 3 & snr < 10 \\ 3-(snr-10)/35*1.5 & 10 <= snr <= 45 \\ 1.5 & \text{else} \end{cases} \quad (4)$$

The value SNR_new[w, k] obtained above is an instantaneous subband SN ratio which limits the minimum value of the subband SN ratio in the current frame. For a speech portion signal having a high SN ratio on the whole, this SNR_new[w, k] allows the minimum value taken by the subband SN/ratio to decrease to 1.5 (dB). Meanwhile, the subband SN ratio cannot be lowered to below 3 (dB) for a noise portion signal having a low instantaneous SN ratio.

The Pr(Sp) calculating circuit 117 calculates a probability Pr(Sp) which indicates the probability that speech is present in the input signal which assumes a noise-free condition. This probability Pr(Sp) is calculated using the NR_level function obtained by the maximum signal calculating circuit 115D.

The Pr(Sp|Y) calculating circuit 118 calculates a probability Pr(Sp|Y) which indicates the probability that speech is present in the actual input signal y[t] having noise mixed thereinto. This probability Pr(Sp|Y) is calculated by using the probability Pr(Sp) supplied from the Pr(Sp) calculating circuit 117 and the subband SN ratio SNR_new[w, k] obtained in accordance with the equation (4). In the calculation of the probability Pr(Sp|Y), the probability Pr(H1|Y)[w, k] means the probability of a speech event H1 in each of the subbands w of the spectrum amplitude signal Y[w, k], wherein the speech event H1 is a phenomenon that in a case where the input signal y(t) of the current frame is a sum of the speech signal s(t) and the noise signal n(t), the speech signal s[t] exists therein. As the SNR_new[w, k] increases, for example, the probability Pr(H1|Y)[w, k] approaches 1.0.

In the maximum likelihood filter 119, using the spectral amplitude signal Y[w, k] from the band division circuit 114 and the noise spectral amplitude signal N[w, k] from the noise estimation circuit 115, the noise removed spectral signal H[w, k] is calculated by removing the noise signal N from the spectral amplitude signal Y in accordance with the following equation (5):

$$H[w,k] = \begin{cases} \alpha + (1-\alpha)\cdot sqrt(Y^2 - N^2)/Y; & Y > 0 \text{ and } Y >= N \\ \alpha; & \text{else.} \end{cases} \quad (5)$$

In the soft decision suppression circuit 120, using the noise removed spectral signal H[w, k] from the maximum likelihood filter 119 and the probability Pr(H1|Y)[w, k] from the Pr(Sp|Y) calculating circuit 118, spectral amplitude suppression in accordance with the following equation (6) is given to the noise removed spectral signal H[w, k] so as to output a spectral suppressed signal Hs[w, k] on the subband basis. MIN_GAIN in the equation (6) is a predetermined constant meaning the minimum gain and set to, for example, 0.1 (−15 dB). According to the equation (6), amplitude suppression given to the noise removed spectral signal H[w, k] is lightened when the speech signal presence probability Pr(H1|Y)[w, k] is close to 1.0. Meanwhile, when the probability Pr(H1|Y)[w, k] is close to 0.0, the noise removed spectral signal H[w, k] is amplitude-suppressed to the minimum gain MIN_GAIN.

$$Hs[w,k]=Pr(H1|Y)[W,k]*H[w,k]+(1-Pr(H1|Y)[w,k])*MIN_GAIN \quad (6)$$

In the filter processing circuit 121, the spectral suppressed signal Hs[w, k] from the soft decision suppression circuit 120 is smoothed along both the frequency axis and the time axis in order to reduce the perceivable discontinuities in the spectral suppressed signal Hs[w, k]. In the band conversion circuit 122, the smoothed signals fed from the filter processing circuit 121 are converted to extended bands through interpolation.

In the spectrum correction circuit 123, the imaginary part of the FFT coefficients of the input signal obtained at the FFT circuit 113 and the real part of FFT coefficients of obtained at the band conversion circuit 122 are multiplied by the output signal of the band division circuit 114 to carry out spectrum correction.

The IFFT circuit 124 executes inverse FFT processing on the signal obtained at the spectrum correction circuit 123. The overlap-and-add circuit 25 executes overlap processing on each frame's boundary portion of the IFFT output signal for each frame. The noise-reduced signal is output from the output terminal 126.

As described so far, the conventional noise suppression device is configured in such a way that even when the noise/speech level of the input signal changes, the amount of noise suppression can be optimized in response to the subband SN ratios. For a speech signal portion having a high SN ratio as a whole, for example, since the minimum value of each subband SN ratio is set to a low value, it is possible to reduce the amount of amplitude suppression in low SN ratio subbands and therefore prevent low level speech signals from being suppressed. In addition, for a noise portion signal having a low SN ratio as a whole, since the minimum value of each subband SN ratio is set to a high value, it is possible to give sufficient amplitude suppression to low SN ratio subbands and therefore suppress perceivable noise.

In the conventional noise suppression device configured as described above, the amount of noise suppression should be uniform along the frequency axis over the whole band so as not to cause residual noise. However, since the estimated noise spectrum of the current frame is obtained by averaging past noise spectrums, the estimated noise spectrum may not equal to the actual noise spectrum. This results in errors in estimated subband SN ratios, making it impossible to give a uniform amount of noise suppression along the frequency axis over the whole band.

Practically, if a noise frame has high power spectral components in a specific subband, this subband is considered to have a high SN ratio as speech and therefore not given sufficient noise suppression. This makes the suppression characteristics not uniform over the whole band and results in causing residual noise. In the conventional method, however, since control is performed depending on the estimated noise spectrum and the estimated subband SN ratios, appropriate noise suppression is impossible if the estimated noise spectrum is not correct.

The present invention is directed to the above-mentioned problem, and it is an object of the present invention to provide a noise suppression device which reduces residual noise in noise frames in a simple way and is free from quality deterioration in noisy environment regardless of noise level fluctuations.

DISCLOSURE OF INVENTION

A noise reduction device including: an input signal spectrum obtaining unit configured to obtain an input signal spectrum by a subband unit based on a current frame of an input signal; an estimated noise spectrum obtaining unit configured to obtain an estimated noise spectrum by the subband unit estimated based on a past frame; an SN ratio obtaining unit configured to obtain a SN ratio, based on the input signal spectrum obtained by the input signal spectrum obtaining unit, the estimated noise spectrum obtained by the estimated noise spectrum obtaining unit, and a function of the input signal spectrum obtained by the input signal spectrum obtaining unit; a spectral reduction factor obtaining unit configured to obtain a spectral reduction factor based on the SN ratio obtained by the SN ratio obtaining unit; and a noise reduction signal obtaining unit configured to obtain a signal whose noise is reduced based on the input signal and the spectral factor reduction obtained by the spectral reduction factor obtaining unit.

A noise reduction method including: obtaining an input signal spectrum by a subband unit based on a current frame of an input signal; obtaining an estimated noise spectrum by the subband unit estimated based on a past frame; obtaining a SN ratio by the subband unit, based on the input signal spectrum, the estimated noise spectrum, and a function of the input signal spectrum; obtaining a spectral reduction factor based on the SN ratio; and obtaining a signal whose noise is reduced based on the input signal and the spectral reduction factor.

An effect of this is that noise can be suppressed uniformly over the whole frequency band and therefore residual noise occurrence can be reduced.

BEST MODE FOR CARRYING OUT THE INVENTION

A description will be made hereinafter of preferred embodiment of the present invention with reference to the accompanying drawings to explain the present invention in detail.

First Embodiment

Figure 3:
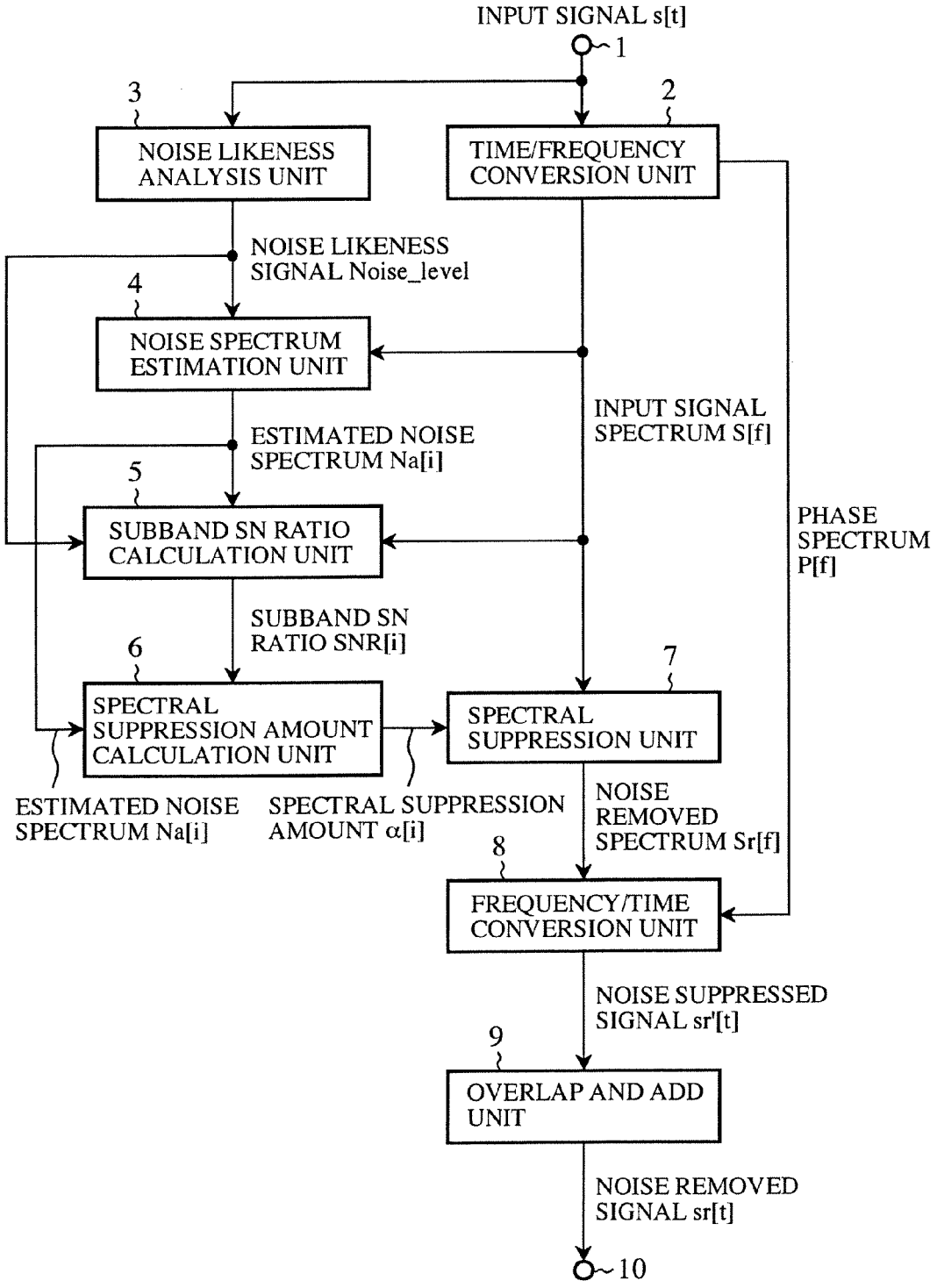
FIG. 3 is a block diagram showing a configuration of a noise suppression device according to a first embodiment of the present invention.

FIG. 3 is a block diagram showing a configuration of a noise suppression device according to a first embodiment of the present invention. In the figure, reference numeral 1 denotes an input terminal; 2 is a time/frequency conversion unit for analyzing the input signal on the frame basis and converting the input signal into an input signal spectrum and a phase spectrum; 3 is a noise likeness analysis unit for calculating a noise likeness signal, which is an index of whether an input signal frame is noise or speech; and 4 is a noise spectrum estimation unit for receiving the input signal spectrum obtained by the time/frequency conversion unit 2, and calculating the input signal average spectrum on the subband basis and updating the subband-based estimated noise spectrum estimated from past frames, on the basis of the calculated subband-based input signal average spectrum and the noise likeness signal calculated by the noise likeness analysis unit 3.

Also in FIG. 3, reference numeral 5 denotes a subband SN ratio calculation unit for receiving the noise likeness signal calculated by the noise likeness analysis unit 3, the input signal spectrum produced by the time/frequency conversion unit 2 and also the subband-based estimated noise spectrum updated by the noise spectrum estimation unit 4, calculating the subband-based input signal average spectrum from the received input signal spectrum, calculating the subband-based mixture ratio of the received estimated noise spectrum to the thus calculated input signal average spectrum on basis of the received noise likeness signal, and further calculating the subband-based SN ratio on the basis of the received subband-based estimated noise spectrum, the calculated subband-based input signal average spectrum and the calculated mixture ratio; 6 is spectral suppression amount calculation unit for calculating the subband-based spectral suppression amount with respect to the subband-based estimated noise spectrum updated by the noise spectrum estimation unit 4, by using the subband-based SN ratio calculated by the subband SN ratio calculation unit 5; 7 is spectral suppression unit for carrying out spectral amplitude suppression on the input signal spectrum obtained by the time/frequency conversion unit 2 by employing the subband-based spectral suppression amount calculated by the spectral suppression amount calculation unit 6; 8 is frequency/time conversion unit for converting the noise removed spectrum fed from the spectral suppression unit 7 to a noise suppressed signal in time domain by using the phase spectrum obtained by the time/frequency conversion unit 2; 9 is overlap and addition unit for performing overlap processing on the frame boundary portions of the noise suppressed signal converted by and fed from the frequency/time conversion unit 8 and outputting a noise removed signal which has been subjected to noise reduction processing; and 10 is an output signal terminal.

Figure 1:
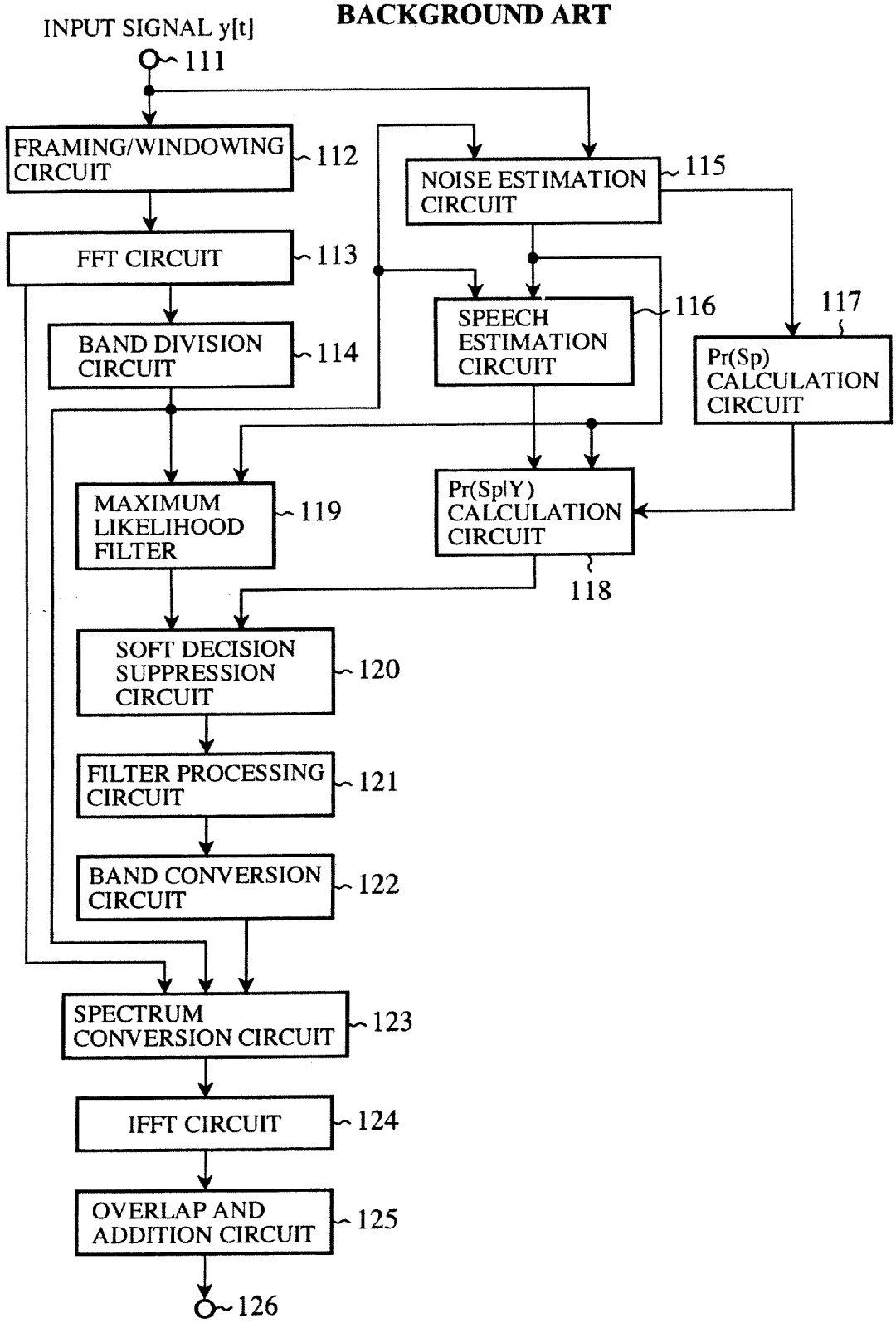
FIG.1 BACKGROUND ART
FIG. 1 is a block diagram showing a configuration of a conventional noise suppression device.
Figure 2:
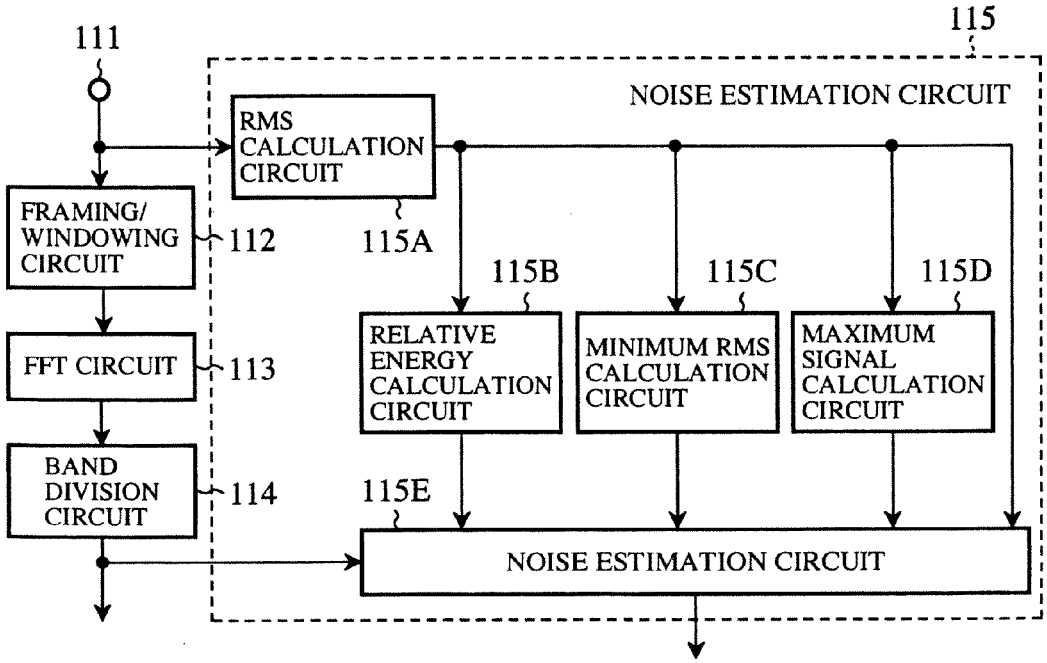
FIG.2 BACKGROUND ART
FIG. 2 is a block diagram showing a configuration of a noise estimation circuit in a conventional noise suppression device.
Figure 4:
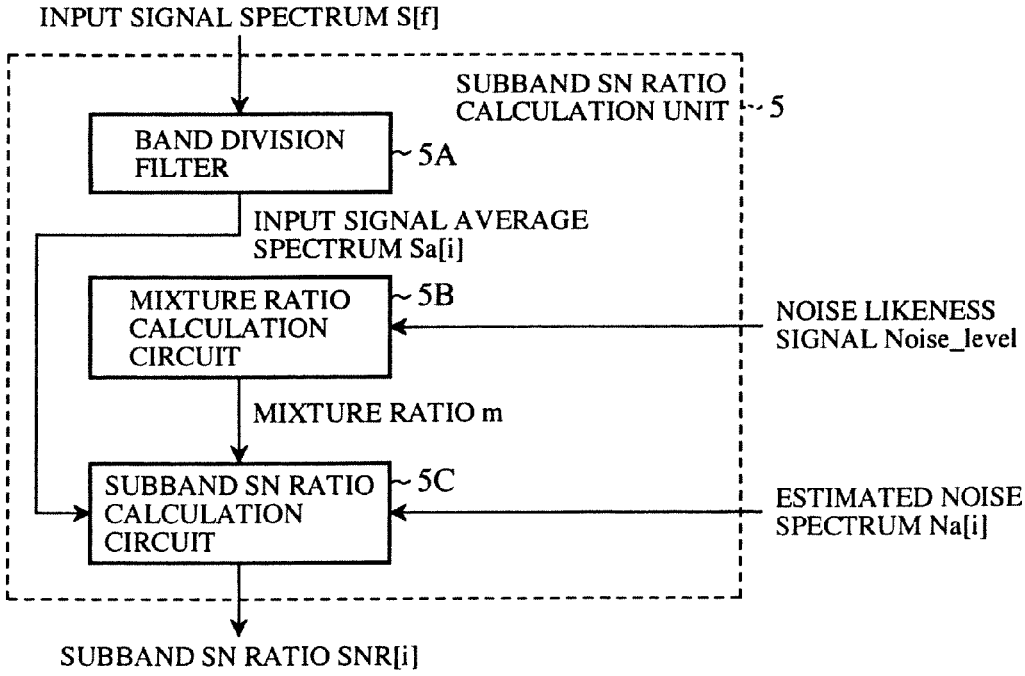
FIG. 4 is a block diagram showing a configuration of subband SN ratio calculation means in the noise suppression device according to the first embodiment of the present invention.

FIG. 4 is a block diagram showing a configuration of the subband SN ratio calculation unit 5 of the noise suppression device in the first embodiment of the present invention. In the figure, reference numeral 5A denotes a band division filter; 5B is a mixture ratio calculation circuit; and 5C is a subband SN ratio calculation circuit.

Figure 5:
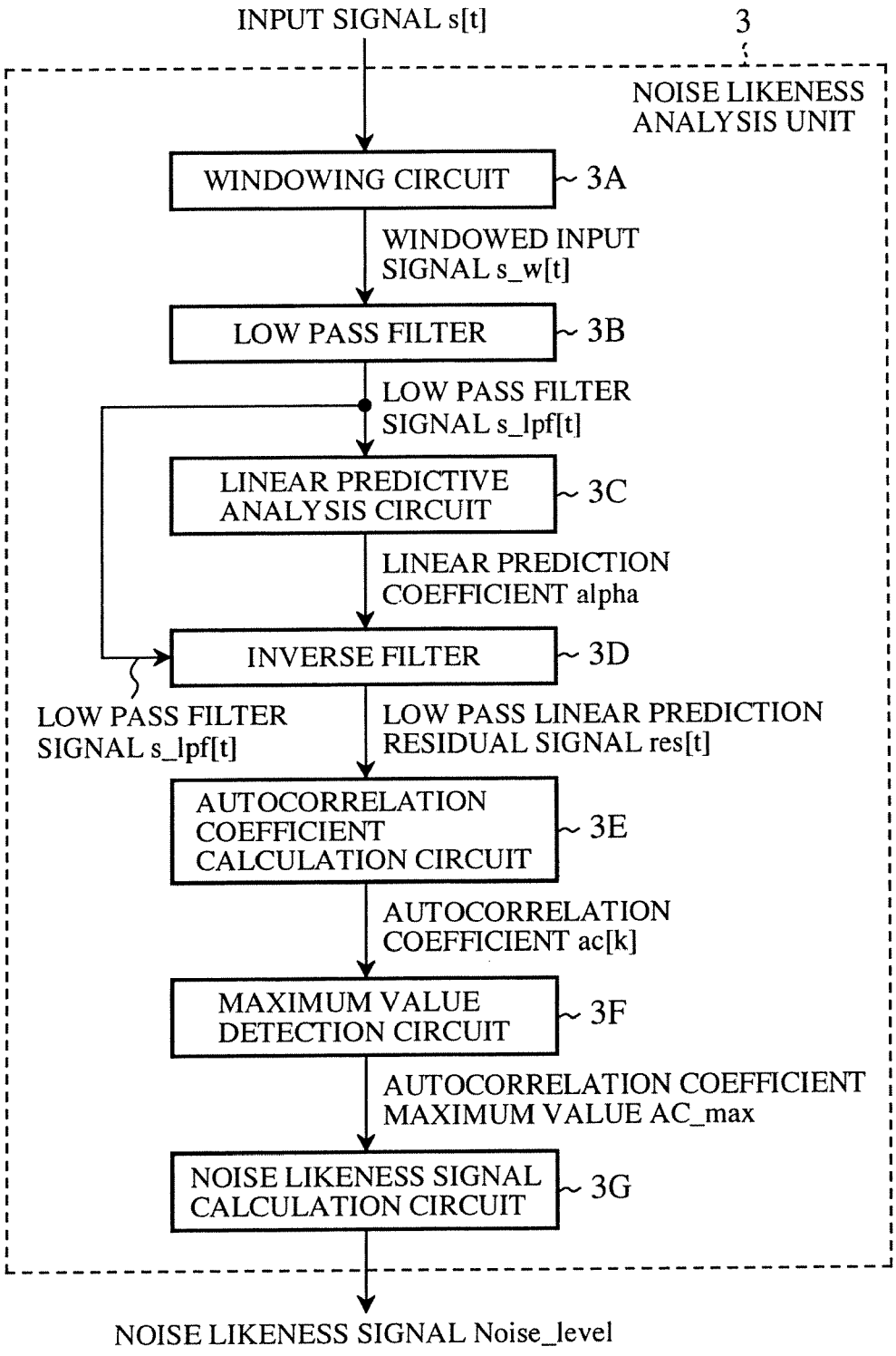
FIG. 5 is a block diagram showing a configuration of noise likeness analysis means in the noise suppression device according to the first embodiment of the present invention.

FIG. 5 is a block diagram showing a configuration of the noise likeness analysis unit 3 in the first embodiment of the present invention. In the figure, reference numeral 3A denotes a windowing circuit; 3B is a low pass filter; 3C is a linear predictive analysis circuit; 3D is an inverse filter; 3E is an autocorrelation coefficient calculation circuit; 3F is a maximum value detection circuit; and 3G is a noise likeness signal calculation circuit.

Figure 6:
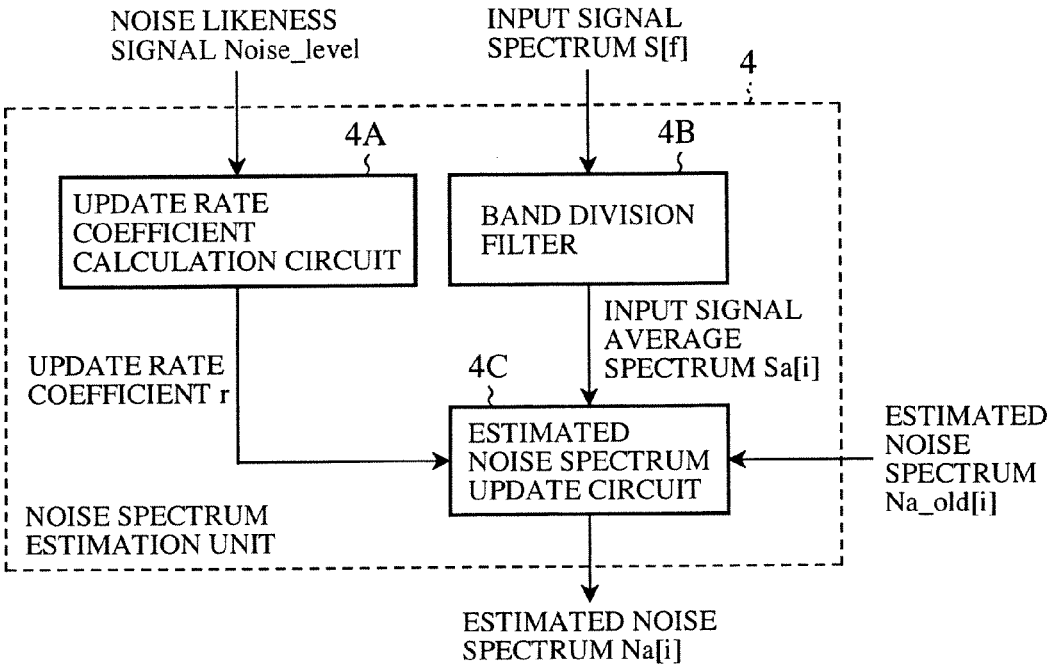
FIG. 6 is a block diagram showing a configuration of noise spectrum estimation means in the noise suppression device according to the first embodiment of the present invention.

FIG. 6 is a block diagram showing a configuration of the noise spectrum estimation unit 4 in the first embodiment of the present invention. In the figure, reference numeral 4A denotes an update rate coefficient calculation circuit; 4B is a band division filter and 4C is an estimated noise spectrum update circuit.

Figure 7:
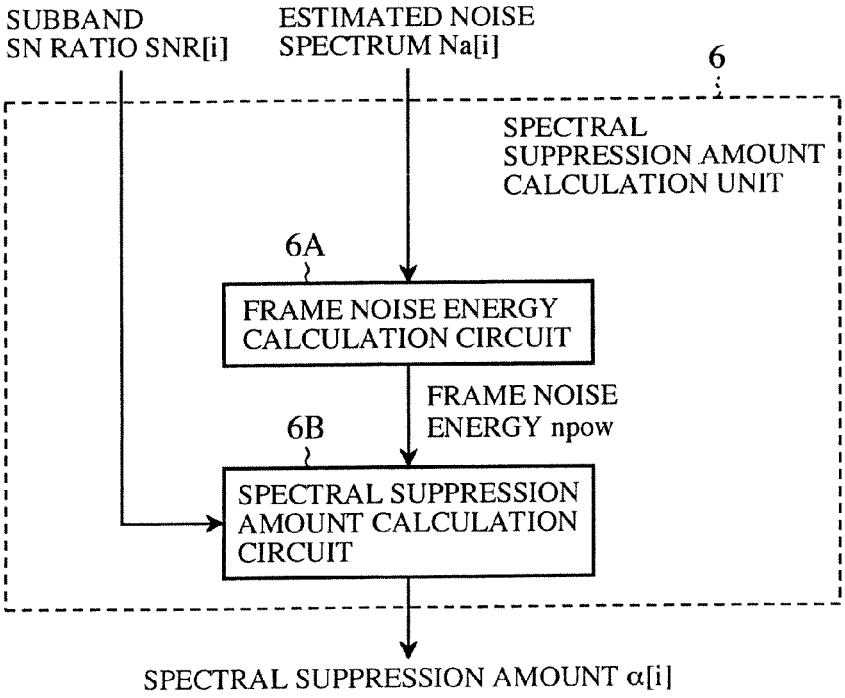
FIG. 7 is a block diagram showing a configuration of spectral suppression amount calculation means in the noise suppression device according to the first embodiment of the present invention.

FIG. 7 is a block diagram showing a configuration of the spectral suppression amount calculation unit 6 in the first embodiment of the present invention. In the figure, reference numeral 6A denotes a frame noise energy calculation circuit and 6B is a spectral suppression amount calculation circuit.

Figures 8, 9:
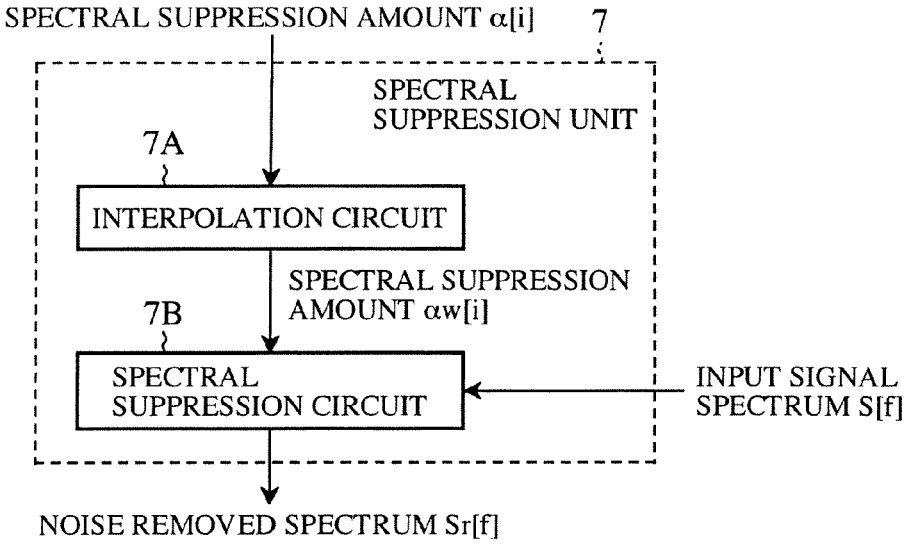
FIG. 8 is a block diagram showing a configuration of spectral suppression means in the noise suppression device according to the first embodiment of the present invention.
FIG. 9 shows a frequency band division table in the noise suppression device according to the first embodiment of the present invention.

FIG. 8 is a block diagram showing a configuration of the spectral suppression unit 7 in the first embodiment of the present invention. In the figure, reference numeral 7A denotes an interpolation circuit and 7B is a spectral suppression circuit.

The operation will then be explained.

The input signal s[t] is sampled at a predetermined sampling frequency (for example 8 kHz) and divided into frames each having a predetermined length (for example 20 ms) before entering the input signal terminal 1. This input signal s[t] is a speech signal containing some background noise or a signal containing background noise only.

In the time/frequency conversion unit 2, the input signal s[t] is converted into an input signal spectrum S[f] and a phase spectrum P[f] on the frame basis by employing FFT at, for example, 256 points. Explanation of the FFT is omitted because it is a widely known technique.

In the subband SN ratio calculation unit 5, using the input signal spectrum S[f], which is an output of the time/frequency conversion unit 2, the noise likeness signal Noise_level, which is an output of the noise likeness analysis unit 3 described later, and the estimated noise spectrum Na[i], which is an output of the noise spectrum estimation unit 4 and indicates an average noise spectrum estimated from past frames judged as noise, the current frame's subband-based SN ratio (hereinafter denoted as the subband SN ratio) SNR[i] is obtained in a way as described below.

FIG. 9 shows a frequency band division table employed in the noise suppression device according to the first embodiment of the present invention. First, in preparation for obtaining the subband SN ratio SNR[i], the frequency band is divided into nineteen small bands (subbands) in such a manner that a low frequency subband is given a narrow bandwidth and a higher frequency subband is given a larger bandwidth, for example as shown in FIG. 9. In this band division, using the band division filter 5A in FIG. 4, the average power spectrum of each subband i is obtained by averaging the power spectrum components (some of f=0-127 in the input signal spectrum S[f]) which belong to the subband, according to the following equation (7). The obtained average value is output as Sa[i], the input signal average spectrum of subband i.

$$Sa[i] = \sum_{f=fl[i]}^{fh[i]} s[f]/(fh[i] - fl[i] + 1),\ i = 0, \ldots, 18 \tag{7}$$

The mixture ratio calculation circuits 5B in FIG. 4 receives the noise likeness signal Noise_level described later and calculates the mixture ratio m of the estimated noise spectrum Na[i] outputted from the noise spectrum estimation unit 4 described later to the input signal average spectrum Sa[i] outputted from the above band division filter 5A. The mixture ratio m which will be used in the calculation of the subband SN ratio SNR[i]. Here, the noise likeness signal Noise_level is used as the mixture ratio m and the function to determine the mixture ratio m is given by the following equation (8).

$$m = \text{Noise_level} \tag{8}$$

If the mixture ratio m is made proportional to the noise likeness signal Noise_level like the above equation (8), the mixture ratio m becomes larger as the noise likeness signal Noise_level increases. Reversely, if the noise likeness signal Noise_level decreases, the mixture ratio m decreases.

In the subband SN ratio calculation circuit 5C in FIG. 5, using the input signal average spectrum Sa[i] from the band division filter 5A, the estimated noise spectrum Na[i] from the noise spectrum estimation unit 4 and the mixture ratio m from the mixture ratio calculation circuit 5B, the subband SN ratio SNR[i] is calculated for subband i according to the following equation (9).

$$SNR[i] = \begin{cases} 20 * \log10\{Sa[i]/(1-m)Na[i] + mSa[i]\}[\text{dB}]; & Sa[i] >= Na[i] \\ 0[\text{dB}]; & Sa[i] < Na[i]. \end{cases} \tag{9}$$

Using the mixture ratio m in the calculation of the subband SN ratio SNR[i] makes it possible to enhance the smoothing of the subband SN ratio SNR[i] along the frequency axis when noise is dominant in the current frame and lighten the smoothing of the subband SN ratio SNR[i] along the frequency axis when noise is not dominant in the current frame. That is, the smoothing of the subband SN ratio SNR[i] along the frequency axis can be controlled according to the noise likeness of the current frame.

Figure 10A:
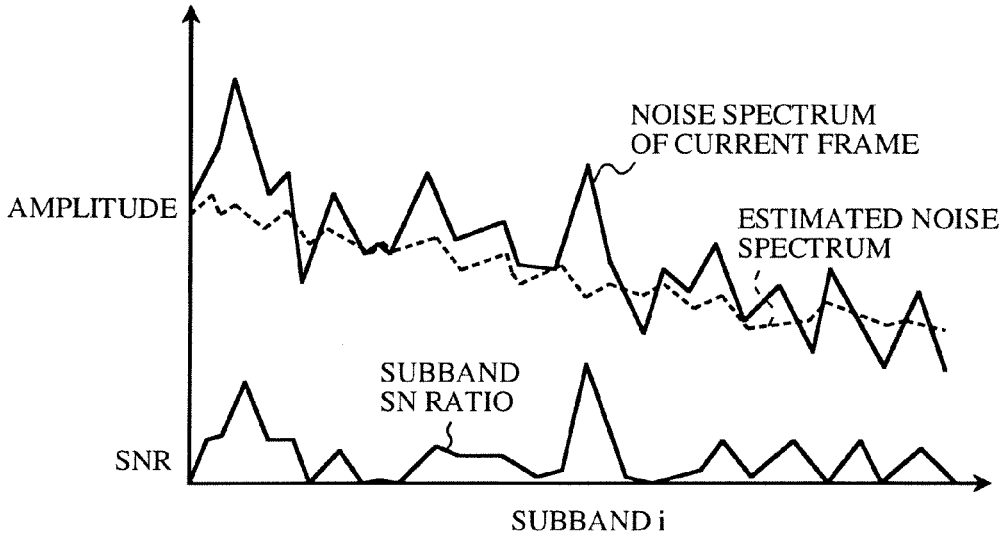
FIG. 10 shows relations between the input signal average spectrum and the estimated noise spectrum and the subband SN ratio in the noise suppression device according to the first embodiment of the present invention.
Figure 10B:
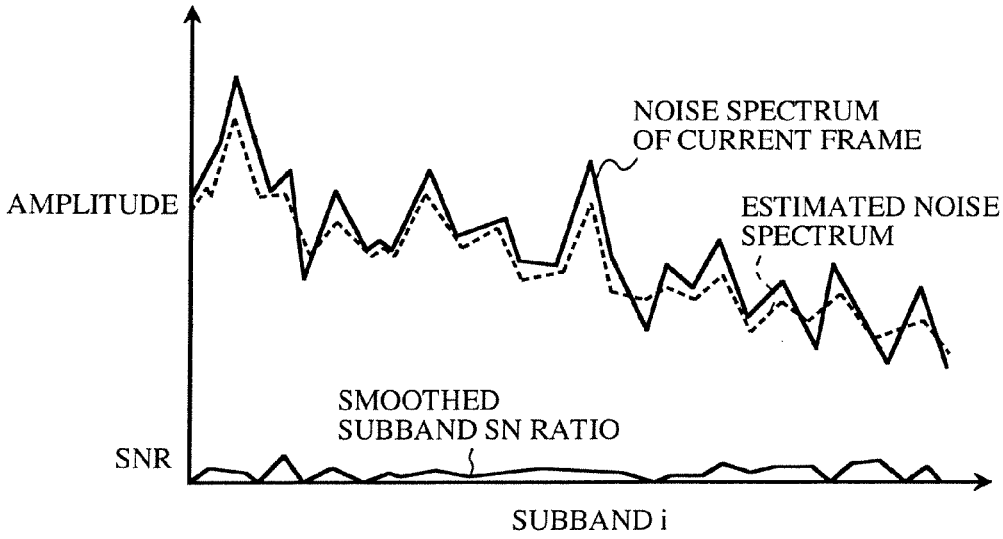

FIG. 10 shows relations between the input signal average spectrum Sa[i](noise spectrum in the current frame: solid line) and the estimated noise spectrum Na[i] (broken line) estimated from past noise spectrums and the subband SN ratio SNR[i] derived from Sa[i] and Na[i] in the noise suppression device according to the first embodiment of the present invention when the current frame is a noise frame. For FIG. 10A, the input signal average spectrum Sa[i] is not added to the estimated noise spectrum Na[i] in the calculation of the subband SN ratio SNR[i], resulting in large fluctuations of the obtained subband SN ratio SNR[i] along the frequency axis. On the other hand, for FIG. 10B, the input signal average spectrum Sa[i] is added to the estimated noise spectrum Na[i] in the calculation of the subband SN ratio SNR[i] at a mixture ratio of m=0.9, resulting in small fluctuations of the obtained subband SN ratio SNR[i] along the frequency axis because the estimated noise spectrum Na[i] can be approximated to the actual noise spectrum of the current frame. Accordingly, it is possible to smooth the subband SN ratio SNR[i] of a noise frame where high power spectral components are present so that estimating the subband SN ratio SNR[i] inappropriately higher (or lower) can be prevented.

In the noise likeness analysis unit 3, the input signal s[t] is received to calculate the noise likeness signal Noise_level, which is an index of whether the mode of the current frame is noise or speech, in a way as described below.

First, the windowing circuit 3A performs windowing processing on the input signal s[t] according to the following equation (10) and outputs the windowed input signal s_w[t]. As the window function, the Hanning window Hanwin[t] is employed. N means the frame length and N=160 is assumed.

$$S_W[t]=\text{Hanwin}[t]*s[t],t=0,\ldots N-1$$

$$\text{Hanwin}[t]=0.5+0.5*\cos(2\pi t/2N-1) \tag{10}$$

The low pass filter 3B receives the windowed input signal s_w[t] from the windowing circuit 3A and executes low pass filter processing on the signal with a cutoff frequency of, for example, 2 kHz, to obtain a low pass filter signal s_lpf[t]. This low pass filtering allows steady analysis in the autocorrelation analysis described later because the effect of high frequency noise is removed.

The linear predictive analysis circuit 3C receives the low pass filter signal s_lpf[t] from the low pass filter 3B and calculates a linear prediction coefficient (for example, 10th order α parameter) alpha by using such a technique as the widely known Levinson-Durbin's method.

The reverse filter 3D receives the low pass filter signal s_lpf[t] and the liner prediction coefficient alpha from the low pass filter 3B and the liner predictive analysis circuit 3C, respectively, and executes reverse filter processing on the low pass filter signal s_lpf[t] to output a low pass linear prediction residual signal res[t].

The autocorrelation coefficient calculation circuit 3E receives the low pass linear prediction residual signal res[t] from the reverse filter 3D and obtains the Nth order autocorrelation coefficient ac [k] by performing autocorrelation analysis on the signal according to the following equation (11).

$$ac[k]=1/N\sum_{t=0}^{N-k-1} res[t]*res[t+k] \tag{11}$$

The maximum value detection circuit 3F receives the autocorrelation coefficient ac [k] from the autocorrelation coefficient calculation circuit 3E and retrieves the positive and largest one out of the autocorrelation coefficient ac[k]. The retrieved one is output as an autocorrelation coefficient maximum value AC_max.

The noise likeness signal calculation circuit 3G receives the autocorrelation coefficient maximum value AC_max from the maximum value detection circuit 3F and outputs a noise likeness signal Noies_level according to the following equation (12). AC_max_h and AC_max_l in the equation (12) are predetermined threshold values to limit the value of AC_max. For example, AC_max_h=0.7 and AC_max_l=0.2 are employed.

$$\text{Noise_level}=\begin{cases}1.0; & \text{AC_max}<\text{AC_max_l}\\ 1.0-\text{AC_max}; & \text{AC_max_h}<=\text{AC_max}<=\text{AC_max_l}\\ 0.0; & \text{AC_max}>\text{AC_max_h}\end{cases} \tag{12}$$

The noise spectrum estimation unit 4, shown in FIG. 6, receives the noise likeness signal Noise_level from the noise likeness analysis unit 3. After determining the estimated noise spectrum update rate coefficient r according to the noise likeness signal Noise_level in a way as described below, the noise spectrum estimation unit 4 updates the estimated noise spectrum Na[i] by using the input signal spectrum S[f].

In the update rate coefficient calculation circuit 4A, the estimated noise spectrum update rate coefficient r, used in updating of the estimated spectrum Na[i], is set in such a manner that the input signal spectrum S[f] of the current frame is more reflected when the value of the noise likeness signal Noise_level is closer to 1.0, that is, when the probability that the current frame may be a noise is considered higher. For example, like the following equation (13), the estimated noise spectrum update rate coefficient r is designed to become larger according as the value of Noise_level rises. X1, X2, Y1 and Y2 in the equation (13) each are a predetermined constant. For example, X1=0.9, X2=0.5, Y1=0.1 and Y2=0.01 are employed.

$$r=\begin{cases}Y1; & 1.0>=\text{Noise_level}>X1\\ \dfrac{\{(Y1-Y2)*\text{Noise_level}+(Y2*X1-Y1*X2)\}}{(X1-X2)}; & X1>=\text{Noise_level}>X2\\ 0.0; & \text{else}\end{cases} \tag{13}$$

Subsequently, the input signal spectrum S[f] is converted into the subband-based input signal average spectrum Sa[i] by using the band division filter 4B used by the subband SN ratio calculation unit 5 described above, and then, the estimated noise spectrum Na[i], estimated from past frames, are updated by the estimated noise spectrum update circuit 4C according to the following equation (14). Na_old[i] in the equation (14) denotes an estimated noise spectrum stored in an internal memory (not shown) of the noise suppression device before the update is done. Na[i] denotes an estimated noise spectrum after the update is done.

$$Na[i]=(1-r)*Na_\text{old}[i]+r*Sa[i];i=0,\ldots,18 \tag{14}$$

In the spectral suppression amount calculation unit 6 in FIG. 7, the subband-based spectral suppression amount α[i], where i denotes a subband, is calculated in a way as described below based on the frame noise energy npow determined from the subband SN ratio SNR[i], which is an output of the subband SN ratio calculation unit 5, and the estimated noise spectrum Na[i], which is an output of the noise spectrum estimation unit 4.

The frame noise energy calculation circuit 6A receives the estimated noise spectrum Na[i] from the noise spectrum estimation unit 4 and calculates the frame noise energy npow, which is the noise power of the current frame, according to the following equation (15).

$$npow = 20 * \log10\left(\sum_{i=0}^{18} Na[i]\right) \tag{15}$$

The spectral suppression amount calculation circuit 6B receives the subband SN ratio SNR[i] and the frame noise energy npow and calculates a spectral suppression amount A[i] (dB) according to the following equation (16). The calculated spectral suppression amount A[i] is converted to a linear value spectral suppression amount α[i] before it is output. Note that the function min(a, b) returns one of the two arguments a and b, whichever is smaller. MIN_GAIN in the equation (16) is a predetermined threshold for preventing excessive suppression. For example, MIN_GAIN=10 (dB) is employed.

$$A[i]=SNR[i]-\min(\text{MIN_GAIN}, npow)$$

$$\alpha[i]=10^{A[i]/20} \tag{16}$$

The spectral suppression unit 7 in FIG. 8 receives the input signal spectrum S[f] and the spectral suppression amount α[i] from the time/frequency conversion unit 2 and the spectral suppression amount calculation unit 6, respectively, gives spectral amplitude suppression to the input signal spectrum S[f] and outputs obtained noise-removed spectrum Sr[f].

The interpolation circuit 7A receives the spectral suppression amount α[i] and expands the subband-based suppression amount α[i] to the spectral components in the subband. The output spectral suppression amount αw[f] consists of suppression amounts which are to be applied respectively to the spectral components f.

The spectral suppression circuit 7B gives spectral amplitude suppression to the input signal spectrum S[f] according to the following equation [17], and outputs the obtained noise-removed spectrum Sr[f].

$$Sr[f]=\alpha w[f]*S[f] \tag{17}$$

The procedure performed by the frequency/time conversion unit 8 is opposite to that performed by the time/frequency conversion unit 2. By performing inverse FFT, for example, the noise-removed spectrum Sr[f] that is output of the spectral suppression unit 7 and the phase spectrum P[f] that is output of the time/frequency conversion unit 2 are converted to a noise-suppressed signal sr'[t] in time domain.

The overlap and addition circuit 9 performs overlap processing on the frame boundary portions of the frame-based inverse FFT output signal sr'[t] received from the frequency/time conversion unit 8. After this noise reduction processing, the obtained noise-removed signal sr[t] is output from the output signal terminal 10.

As described above, in the first embodiment, since the estimated noise spectrum Na[i] can be approximated to the noise spectrum of the current frame in the calculation of the subband SN ratio SNR[i], the calculated subband SN ratio [i] is free from large fluctuations along the frequency axis as shown in FIG. 10B. Even in a subband containing high power spectral components of a noise frame, it is possible to prevent the subband SN ratio SNR[i] from being estimated inappropriately higher (or lower). Since spectral amplitude suppression is performed using a spectral suppression amount α[i] derived from this subband SN ratio SN ratio SNR[i] free from large fluctuations along the frequency axis, this embodiment provides such an effect that noise can be suppressed uniformly over the whole frequency band and therefore residual noise occurrence can be reduced.

Second Embodiment

The mixture ratio m calculated by the subband SN ratio calculation unit 5 in the first embodiment described above can be modified in such a manner that it is controlled as a subband-based mixture ratio m[i] capable of having a different value for each subband i by using, for example, a function of the noise likeness signal Noise_level.

For example, the subband-based mixture ratio m[i] can be designed to have a large value when the noise likeness signal Noise_level is large and to have a small value when the noise likeness signal Noise_level is small as determined by the following equation (18).

$$\begin{aligned}
m[0] &= \text{Noise_level};\ 1.0 >= \text{Noise_level} > \text{N_TH}[0],\ \text{N_TH}[0] = 0.6 \\
m[1] &= \text{Noise_level};\ 1.0 >= \text{Noise_level} > \text{N_TH}[1],\ \text{N_TH}[1] = 0.6 \\
&\vdots \\
m[9] &= \text{Noise_level};\ 1.0 >= \text{Noise_level} > \text{N_TH}[9],\ \text{N_TH}[9] = 0.5 \\
m[10] &= \text{Noise_level};\ 1.0 >= \text{Noise_level} > \text{N_TH}[10],\ \text{N_TH}[10] = 0.4 \\
m[11] &= \text{Noise_level};\ 1.0 >= \text{Noise_level} > \text{N_TH}[11],\ \text{N_TH}[11] = 0.3 \\
&\vdots \\
m[18] &= \text{Noise_level};\ 1.0 >= \text{Noise_level} > \text{N_TH}[18],\ \text{N_TH}[18] = 0.3 \\
m[i] &= 0.0;\ \text{else},\ i = 0, \ldots 18
\end{aligned} \tag{18}$$

In addition, since the accuracy of noise spectrum estimation generally deteriorates more in high frequency subbands than in low frequency subbands, the threshold N_TH[i] used to pass the value of the noise likeness signal Noise_level to the subband mixture ratio m[i] in the equation (18) is designed so as to have a lower value for a higher subband. By setting the threshold value N_TH[i] lower in a higher band, the subband mixture ratio m[i] in a higher subband can be made larger. This enhances the smoothing of the subband SN ratio SNR[i] in high frequency regions to suppress the deterioration of the noise spectrum estimation accuracy in high frequency regions.

Note that it is not necessary for the threshold N_TH[i] to have a different value for each subband. It is no problem that the same value is set to two adjacent subbands such as subbands 0 and 1, and subbands 2 and 3, for example.

Although each subband is provided with a function to control the mixture ratio on the subband basis in this embodiment, it is also possible to employ such a composite configuration that while a mixture ratio m calculated from the whole frequency band is output for low frequency subbands 0 through 9 as is done in the first embodiment, each of the remaining higher frequency subbands 10 through 18 is individually given a mixture ratio m as is done in the second embodiment. This composite configuration can reduce the number of operations and the amount of memory required to calculate the mixture ratios.

As described above, in the second embodiment, the mixture ratio m is treated as the subband mixture ratio m[i] capable of having a different value for each subband i by using a function of the noise likeness signal Noise_level. The threshold N_TH[i] used to pass the value of the noise likeness signal Noise_level to the subband mixture ratio m[i] can be arranged so as to have a lower value for a higher subband. This makes the subband mixture ratio m[i] have a larger value in a higher subband and therefore provides such an effect that the smoothing of the subband SN ratio SNR[i] can be enhanced in high frequency regions to reduce the deterioration of the noise spectrum estimation accuracy in high frequency regions, resulting in further suppressing residual noise in high frequency regions.

Third Embodiment

In the first embodiment described above, it is possible to make the mixture ratio m have one of a plurality of predetermined values depending on the noise likeness signal in such a manner as to be indicated by the following equation (19), and to make the mixture ratio select a large value when the level of the noise likeness signal Noise_level is high and a small value when the level of the noise likeness signal is low.

$$m = \begin{cases} 0.99; & 1.0 >= \text{Noise_level} > 0.8 \\ 0.8; & 0.8 >= \text{Noise_level} > 0.6 \\ 0.5; & 0.6 >= \text{Noise_level} > 0.5 \\ 0.0; & \text{else} \ldots \end{cases} \tag{19}$$

As described above, according to the third embodiment, since the mixture ratio is set to one of a plurality of predetermined values depending on the noise likeness signal Noise_level, small fluctuations of the mixture ratio m along the time axis are accommodated to a predetermined constant value as compared with the first embodiment where the mixture ratio m is controlled as a function of the noise likeness signal Noise_level which fluctuates along the time axis. This provides such an effect that the mixture ratio m can be set stably and therefore residual noise occurrence can be further suppressed.

Fourth Embodiment

Control of the mixture ratio m in the third embodiment described above can be modified in such a manner that the subband mixture ratio m[i] value is selected from predetermined constant values on the subband basis, which surely provides the same effect.

According to the fourth embodiment, since the subband mixture ratio m[i] is set to one of a plurality of predetermined values depending on the noise likeness signal Noise_level, small fluctuations of the subband mixture ratio m[i] along the time axis are accommodated to a predetermined constant value as compared with the second embodiment where the subband mixture ratio m[i] is controlled as a function of the noise likeness signal Noise_level which fluctuates along the time axis. This provides such an effect that the subband mixture ratio m[i] can be set stably and therefore residual noise occurrence can be further suppressed.

Fifth Embodiment

Control of the subband mixture ratio m[i] in the second embodiment described above can be modified in such a manner that the mixture ratio m[i] is weighted along the frequency axis so as to have a larger value in a higher frequency region.

For example, the noise likeness signal Noise_level is multiplied by a frequency-dependent weighting coefficient w[i] to make the subband mixture ratio m[i] in high frequency regions increase along the frequency axis as shown in the following equation (20). However, if the subband ratio m[i] exceeds 1.0 after weighted, m[i]=1.0 is employed.

Figure 11:
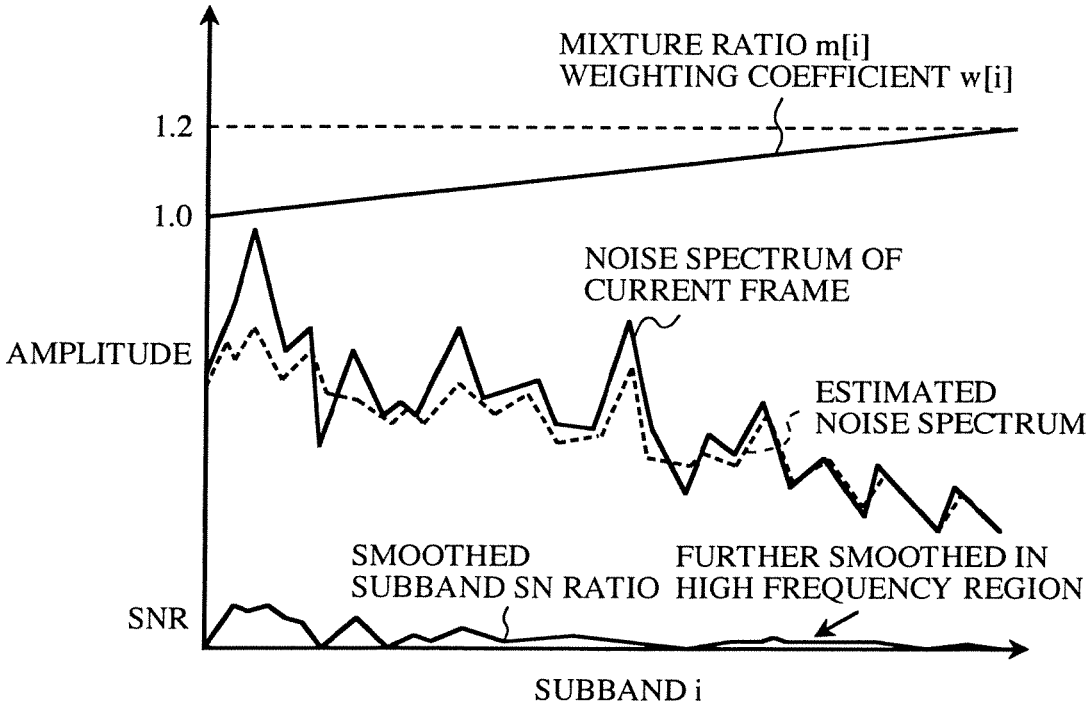
FIG. 11 shows relations between the input signal average spectrum and the estimated noise spectrum and the subband SN ratio the a noise suppression device according to the fifth embodiment of the present invention where the mixture ratio is weighted depending on the frequency.

Shown in FIG. 11 is an example result of weighting the mixture ratio m[i] along the frequency axis under the condition of the equation (20). It is shown that smoothing of the subband SN ratio SNR[i] in high frequency regions is enhanced.

$$\begin{gathered} m[0] = w[0] * \text{Noise_level};\ 1.0 >= \text{Noise_level} > \text{N_TH}[0] = 0.6 \\ m[1] = w[1] * \text{Noise_level};\ 1.0 >= \text{Noise_level} > \text{N_TH}[1] = 0.6 \\ \vdots \\ m[9] = w[9] * \text{Noise_level};\ 1.0 >= \text{Noise_level} > \text{N_TH}[9] = 0.5 \\ m[10] = w[10] * \text{Noise_level};\ 1.0 >= \text{Noise_level} > \text{N_TH}[10] = 0.4 \\ m[11] = w[11] * \text{Noise_level};\ 1.0 >= \text{Noise_level} > \text{N_TH}[11] = 0.3 \\ \vdots \\ m[18] = w[18] * \text{Noise_level};\ 1.0 >= \text{Noise_level} > \text{N_TH}[18] = 0.3 \\ m[i] = 0.0;\ \text{else},\ i = 0, \ldots 18 \\ \text{where},\ w[i] = 1.0 + 0.2 * i / 19 \end{gathered} \tag{20}$$

According to the fifth embodiment 5, since the subband mixture ratio m[i] is weighted so as to increase along the frequency axis, fluctuations of the subband SN ratio SNR[i] in high frequency regions can be smoothed. This provides an effect of further suppressing residual noise occurrence in high frequency regions.

Although weighting is done for all the subbands along the frequency axis in this embodiment, it is also possible to do weighting for only high subbands, for example, subbands 10 through 18.

Sixth Embodiment

Weighting in a way as described in the fourth embodiment is surely possible even if predetermined constants have been used in determining the subband mixture ratio m[i] in place of the function used in the second embodiment. The equation (21) is an example of weighting predetermined constants along the frequency axis.

$$m[i] = \begin{cases} 0.99 * w[i]; & 1.0 >= \text{Noise_level} > 0.8 \\ 0.8 * w[i]; & 0.8 >= \text{Noise_level} > 0.6 \\ 0.5 * w[i]; & 0.6 >= \text{Noise_level} > 0.5 \\ 0.0; & \text{else} \end{cases} \tag{21}$$

$$\text{where},\ w[i] = 1.0 + 0.2 * i / 19 \ldots$$

According to the sixth embodiment, since the subband mixture ratio m[i] is weighted so as to have a larger value in a higher frequency subband, fluctuations of the subband SN ratio SNR[i] in high frequency regions can be smoothed. Combined this effect with the suppression of fluctuations of the subband mixture ratio m[i] in the time axis by use of predetermined constants, this provides an effect of further suppressing residual noise occurrence.

Seventh Embodiment

Control of the subband mixture ratio m[i] in the fifth embodiment described above can be modified in such a manner that weighting is not done when the noise likeness signal Noise_level of the current frame is below a predetermined threshold m_th[i] as defined by the following equation (22). In the case of the equation (22), the subband mixture ratio m[0], which is the mixture ratio for subband 0, is weighted.

$$m[0] = \begin{cases} w[0] * \text{Noise_level}; & 1.0 >= \text{Noise_level} > 0.6 \text{ and Noise_level} > \text{m_th}[0] \\ \text{Noise_level}; & 1.0 >= \text{Noise_level} > 0.6 \\ 0.0; & \text{else} \end{cases} \quad (22)$$

According to the seventh embodiment, since weighting is done only when the noise likeness signal Noise_level is beyond a predetermined threshold value, this embodiment provides such an effect that even when a speech frame is misjudged as noise due to the first consonant, for example, unnecessary smoothing/lowering of the SN ratio by the subband SN ratio calculation unit 5 can be prevented so as not to degenerate the quality of the acoustic output.

Eight Embodiment

Control of the subband mixture ratio m[i] in the sixth embodiment described above can be modified in such a manner that weighting is not done when the noise likeness signal Noise_level of the current frame is below a predetermined threshold m_th[i] as defined by the following equation (23).

$$m[i] = \begin{cases} 0.99 * w[i]; & 1.0 >= \text{Noise_level} > 0.8 \text{ and Noise_level} > \text{m_th}[i] \\ 0.99; & 1.0 >= \text{Noise_level} > 0.8 \\ 0.8 * w[i]; & 0.8 >= \text{Noise_level} > 0.6 \text{ and Noise_level} > \text{m_th}[i] \\ 0.8; & 0.8 >= \text{Noise_level} > 0.6 \\ 0.5 * w[i]; & 0.6 >= \text{Noise_level} > 0.5 \text{ and Noise_level} > \text{m_th}[i] \\ 0.5; & 0.6 >= \text{Noise_level} > 0.5 \\ 0.0; & \text{else} \end{cases} \quad (23)$$

where $w[i] = 1.0 + 0.2 * i / 19$

According to the eighth embodiment, since weighting is done only when the noise likeness signal Noise_level is beyond a predetermined threshold value, this embodiment provides such an effect that even when a speech frame is misjudged as noise due to the first consonant, for example, unnecessary smoothing/lowering of the SN ratio by the subband SN ratio calculation unit 5 can be prevented so as not to degenerate the quality of the acoustic output.

INDUSTRIAL APPLICABILITY

As described so far, a noise suppression device according to the present invention is applicable where noise must be suppressed uniformly over the whole frequency band in order to reduce residual noise occurrence.

The invention claimed is:

1. A noise reduction device comprising:

an input signal spectrum obtaining unit configured to obtain an input signal spectrum by a subband unit based on a current frame of an input signal;

an estimated noise spectrum obtaining unit configured to obtain an estimated noise spectrum by the subband unit estimated based on a past frame;

an SN ratio obtaining unit configured to obtain a SN ratio, based on the input signal spectrum obtained by the input signal spectrum obtaining unit, the estimated noise spectrum obtained by the estimated noise spectrum obtaining unit, and a function of the input signal spectrum obtained by the input signal spectrum obtaining unit;

a spectral reduction factor obtaining unit configured to obtain a spectral reduction factor based on the SN ratio obtained by the SN ratio obtaining unit; and a noise reduction signal obtaining unit configured to obtain a signal whose noise is reduced based on the input signal and the spectral factor reduction obtained by the spectral reduction factor obtaining unit.

2. A noise reduction method comprising:

obtaining an input signal spectrum by a subband unit based on a current frame of an input signal;

obtaining an estimated noise spectrum by the subband unit estimated based on a past frame;

obtaining a SN ratio by the subband unit, based on the input signal spectrum, the estimated noise spectrum, and a function of the input signal spectrum;

obtaining a spectral reduction factor based on the SN ratio; and obtaining a signal whose noise is reduced based on the input signal and the spectral reduction factor.

* * * * *